US005624233A

United States Patent [19]

King et al.

[11] Patent Number: 5,624,233

[45] Date of Patent: Apr. 29, 1997

[54] GAS TURBINE ENGINE ROTARY DISC

[75] Inventors: Michael J. King; Jonathan P. Throssell, both of Derby; David S. Knott, Leicestershire; Martyn Richards, Derbyshire, all of England

[73] Assignee: Rolls-Royce plc, London, England

[21] Appl. No.: 608,545

[22] Filed: Feb. 28, 1996

[30] Foreign Application Priority Data

Apr. 12, 1995 [GB] United Kingdom ..... 9507569

[51] Int. Cl.[6] ..... F01D 5/30

[52] U.S. Cl. ..... 416/219 R; 416/213 R; 416/220 R

[58] Field of Search ..... 416/219 R, 220 R, 416/222, 208, 217, 213 R

[56] References Cited

U.S. PATENT DOCUMENTS

| | | | |
|---|---|---|---|
| 2,603,453 | 7/1952 | Sollinger | 416/213 |
| 2,751,189 | 6/1956 | Ledwith | 416/217 |
| 3,970,412 | 7/1976 | Sundt | 416/213 R |
| 4,527,952 | 7/1985 | Forestier et al. . | |
| 5,197,857 | 3/1993 | Glynn et al. | 416/213 R |
| 5,213,475 | 5/1993 | Peterson et al. . | |
| 5,486,095 | 1/1996 | Rhoda et al. | 416/220 R |
| 5,540,552 | 7/1996 | Surdi | 416/220 R |

FOREIGN PATENT DOCUMENTS

| | | | |
|---|---|---|---|
| 0113598 | 7/1984 | European Pat. Off. . | |
| 0521614 | 1/1993 | European Pat. Off. . | |
| 2292856 | 6/1976 | France | 416/220 R |
| 2561307 | 9/1985 | France | 416/220 R |
| 0020651 | 12/1972 | Japan . | |
| 0346751 | 7/1960 | Switzerland | 416/219 |
| 0706464 | 3/1954 | United Kingdom | 416/213 |
| 710119 | 6/1954 | United Kingdom . | |
| 933047 | 7/1963 | United Kingdom . | |
| 1277836 | 6/1972 | United Kingdom . | |
| 1432875 | 4/1976 | United Kingdom . | |
| 2024959 | 1/1980 | United Kingdom . | |
| 2038959 | 7/1980 | United Kingdom | 416/220 R |

*Primary Examiner*—Edward K. Look
*Assistant Examiner*—Mark Sgantzos
*Attorney, Agent, or Firm*—Cushman Darby & Cushman IP Group of Pillsbury Madison & Sutro, LLP

[57] ABSTRACT

A rotor disc which is suitable for carrying the fan blades of a ducted fan gas turbine engine is constituted by two sub-discs which are maintained in axially spaced apart relationship by a plurality of spacer members. The spacer members are generally axially extending and at least partially define the operational air flow path over the disc.

10 Claims, 3 Drawing Sheets

GAS TURBINE ENGINE ROTARY DISC

FIELD OF THE INVENTION

This invention relates to a rotor disc for a gas turbine engine.

BACKGROUND OF THE INVENTION

Axial flow gas turbine engines conventionally comprise a plurality of rotor discs, each of which carries an annular array of radially extending aerofoil blades on its periphery. One such disc carries the fan aerofoil blades to constitute an assembly which is positioned at the front of a ducted fan gas turbine engine.

The fan rotor assembly of a typical ducted fan gas turbine engine is large and therefore can be heavy. One way in which weight can be saved is to raise the hub to tip ratio of the assembly, that is the ratio of the diameter of the disc or hub to the diameter defined by the tips of the fan blades carried by the disc. This is achieved by increasing the diameter of the disc rim. However, this can only be done if the disc can be machined into a stress and weight efficient shape. Typically the disc is made as a single piece forging and the constraints imposed by its construction frequently prevent the disc being of the most efficient shape.

SUMMARY OF THE INVENTION

It is an object of the present invention to provide a gas turbine engine rotor disc which is so configured as to be both weight and stress efficient.

According to the present invention, a rotor disc suitable for carrying an annular array of radially extending aerofoil blades in a gas turbine engine is provided with a plurality of generally axially extending circumferentially spaced apart slots in its periphery to receive the roots of said aerofoil blades, said rotor disc comprising two or more sub-discs which are maintained in axially spaced apart relationship by a plurality of axially extending circumferentially spaced apart spacer members positioned in the peripheral regions of said sub-discs, said spacer members at least partially defining the radially inner boundary of the operational gas flow path over said disc between adjacent of said blade receiving slots.

BRIEF DESCRIPTION OF THE DRAWINGS

The present invention will now be described, by way of example, with reference to the accompanying drawings in which.

DETAILED DESCRIPTION OF THE INVENTION

Figure 1:
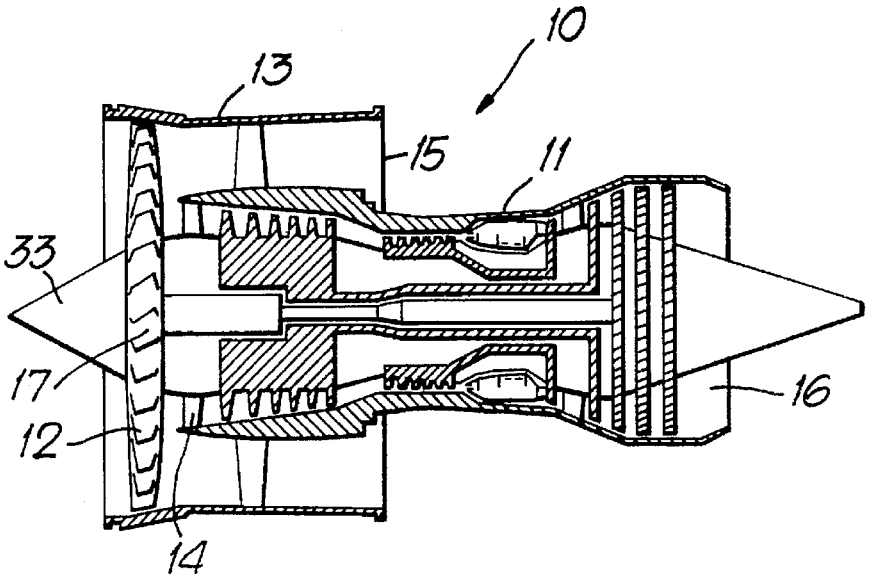
FIG. 1 is a schematic sectioned side view of a ducted fan gas turbine engine which incorporates a rotor disc in accordance with the present invention.

With reference to FIG. 1, a ducted fan gas turbine engine generally indicated at 10 is of conventional configuration comprising a core engine 11 which drives a fan assembly 12.

The fan assembly 12 is contained within an annular casing 13 and is arranged so that air exhausted from the fan assembly 12 is divided into two flows. The first flow is directed with the intake 14 of the core engine 11 to provide the core engine 11 with a supply of pressurised air to facilitate its operation. The second flow is exhausted from the downstream end 15 of the casing 13 to mix with the exhaust efflux from the downstream end 16 of the core engine 11 to provide propulsive thrust.

Figure 2:
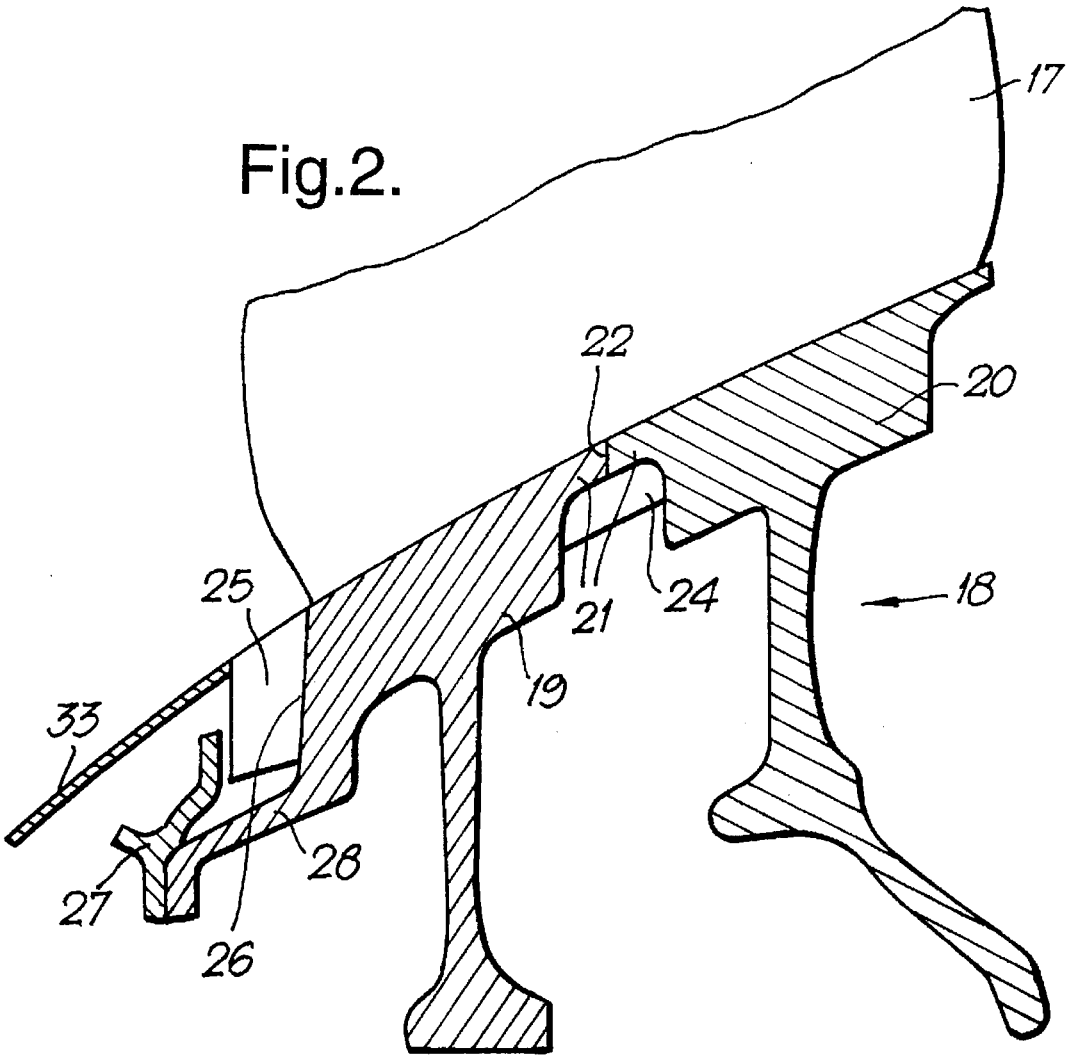
FIG. 2 is a sectioned side view of a rotor disc in accordance with the present invention supporting a fan aerofoil blade.
Figure 3:
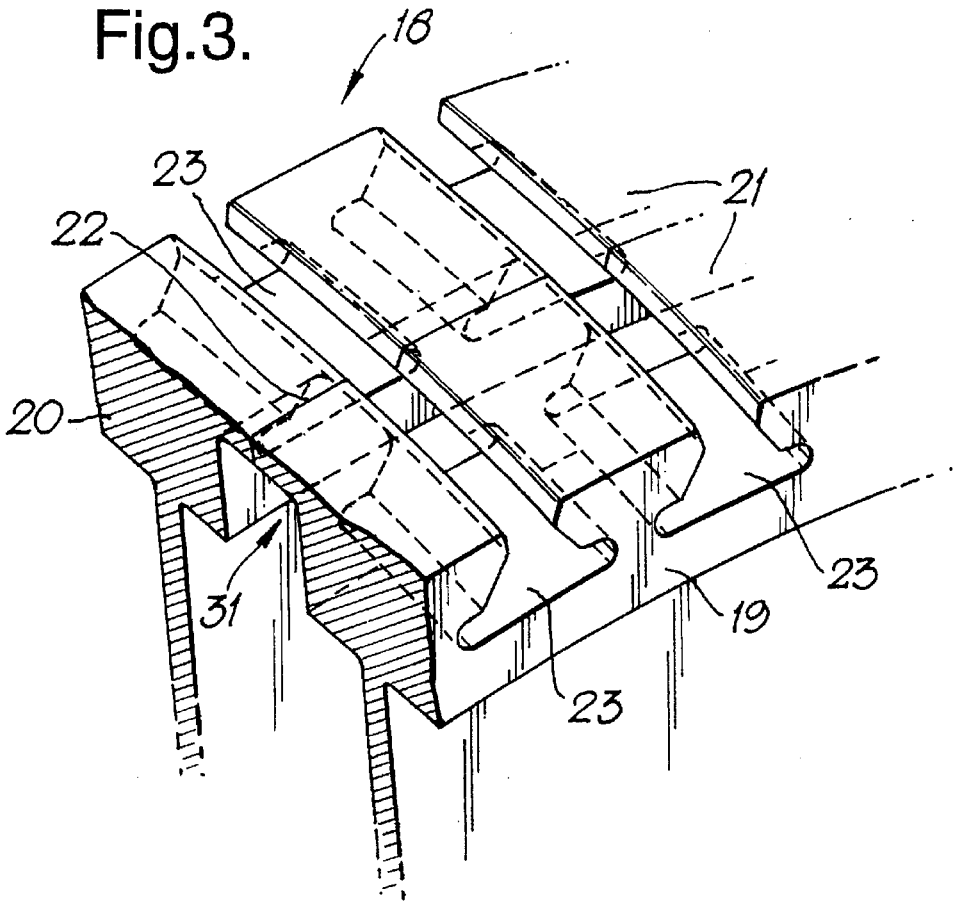
FIG. 3 is an isometric view of a portion of the rotor disc shown in FIG. 1.

The fan assembly 12 comprises an annular array of radially extending aerofoil blades 17 which are mounted on a common rotor disc 18 (shown in FIG. 2) which disc 18 is in accordance with the present invention. Referring to FIGS. 2 and 3, the rotor disc 18 is made up of two sub-discs 19 and 20 which are interconnected in axially spaced apart relationship by a plurality of similar axially extending circumferentially spaced apart spacer members 21. The spacer members 21 are positioned on and are integral with the periphery of each sub-disc 19 and 20. They each extend beyond the axial extent of their associated sub-disc 19 to define a face 22 which confronts the corresponding face 22 of a spacer member 21 positioned on the adjacent sub-disc 20. The confronting faces 22 of axially adjacent spacer members 21 are bonded to each other by welding, although it will be appreciated that other suitable methods of bonding could be employed if so desired.

The spacer members 21 therefore constitute the sole means of interconnection between the axially adjacent sub-discs 19 and 20. This brings benefits in terms of the overall integrity of the disc 18 since the regions of axial interconnection between the spacer members 21 are discontinuous and therefore not subject to hoop stresses.

Circumferentially adjacent spacer members 21 cooperate to define generally axially extending circumferential spaced apart grooves 23. Each groove 23 is of generally dovetail cross-sectional shape to receive the correspondingly shaped root 24 of a fan aerofoil blade 17. Additionally, each groove 23 is axially inclined as can be seen most clearly in FIG. 2 for reasons which will be referred to later. One major effect of such axial inclination is that upon rotation of the disc 18 during operation of the gas turbine engine 10, the various loads imposed upon each fan blade 17 cause it to attempt to slide along its associated groove 23 in a downstream direction. This is resisted, however, by a tang 25 which is attached to the upstream end of the fan blade root 24. The tang 25 is of greater radial depth than its associated root 24 so as to abut the upstream face 26 of the upstream sub-disc 19.

Movement of the fan blade 17 in an upstream direction is prevented by a detachable thrust ring 27 which is attached to a flanged extension 28 of the upstream face 26 of the upstream sub-disc 19.

Figure 4:
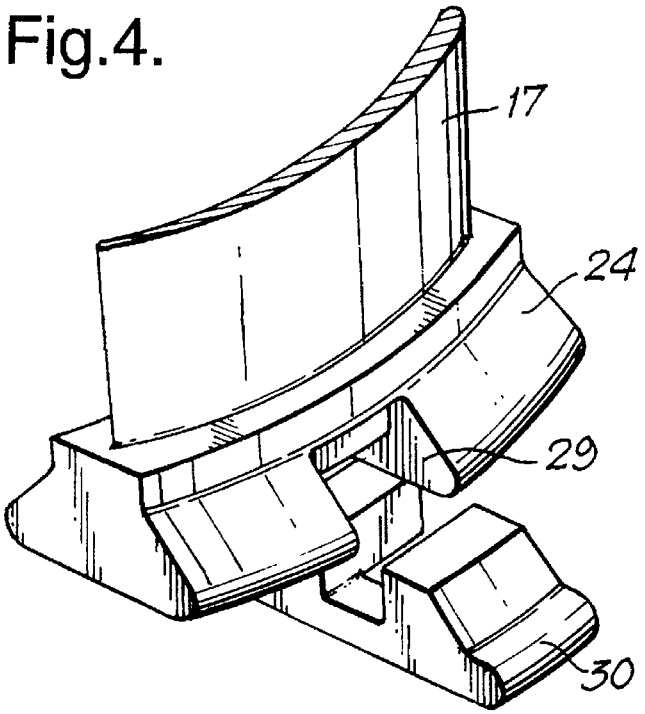
FIG. 4 is an isometric view of the root portion of a fan aerofoil blade provided with an alternative means for axially locking the blade in position on the disc shown in FIG. 3.
Figure 5:
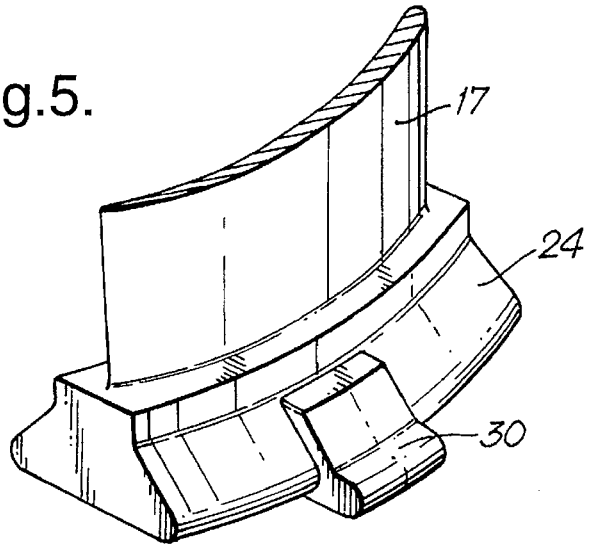
FIG. 5 is a further isometric view of the fan aerofoil blade root portion shown in FIG. 4 with the locking means in position on the root.

If, for any reason, it is undesirable to provide axial retention of each fan blade 17 by use of a tang 25, the configuration of the disc 18 facilitates the use of an alternative way of providing axial fan blade 17 retention. In that alternative way, the tang 25 on each fan blade root 24 is omitted and instead, a slot 29, which can be seen in FIG. 4, is provided in the mid-portion of the underside of the rod 24. The slot 29 receives a generally u-shaped key 30 in the manner shown in FIG. 5. The key 30 is so shaped that when it is positioned within the slot 29, it protrudes beyond the profile of the root 24.

Figure 6:
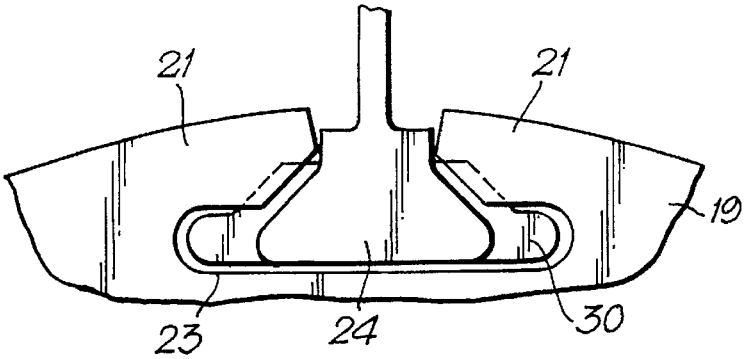
FIG. 6 is a view of the fan aerofoil blade root shown in FIG. 4 in position on the disc shown in FIG. 3 prior to it being axially locked in position.
Figure 7:
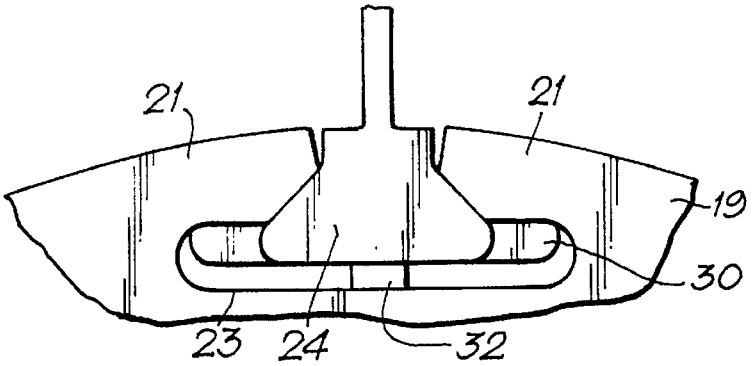
FIG. 7 is a view similar to that shown in FIG. 5 in which the fan aerofoil blade root is axially locked in position on the disc.

The profile of each slot 23 in the disc 18 is radially elongate as can be seen in FIGS. 6 and 7 so that the blade root 24, together with its associated key 30, can be slid into the slot 23. In order to ensure that each key 30 remains in position in its associated slot 29, suitable means of retention, such as an adhesive or other form of bonding, are employed. Alternatively a physical device, such as a flat support member on the underside of the root 24 could be employed if so desired.

The fan blade root 24 is slid into the groove 23 until the root slot 29 is aligned with the annular gap 31 which is defined between the peripheral regions of the sub-discs 19 and 20. The key 30 is arranged to be of approximately the same thickness as the width of the annular gap 31. This is so that the fan blade root 24 can be lifted in a radially outward direction until the key 30 is located axially by the annular groove 31 and the fan blade root 24 abuts the radially outer part of the groove 23 as shown in FIG. 7. An axially elongate chocking member 32 is inserted between the fan blade root 24 and the base of the groove 23 in order to maintain the fan blade root 24 and its associated key 30 in the position shown in FIG. 7. The chocking member 32 is itself maintained in position by a suitably positioned thrust ring (not shown) similar to the thrust ring 27 shown in FIG. 2.

It will be seen therefore that the key 30, through its interaction between the disc 18 and the fan blade root 24 provides effective axial retention of the fan blade root 17 within its groove 23. Nevertheless, removal of the chock 32 provides quick and easy release of the fan blade root 24 from its slot. The key 30 obviates the requirement for the tang 25 which is subject to possibly undesirable bending loads. Moreover, it provides a large abutment area, thereby ensuring effective axial fan blade root 17 retention.

As mentioned earlier, the disc grooves 23 and hence the spaced members 21, are axially inclined. This is so that spacer members 21 can define the most aerodynamically efficient radially inner boundary of the air flow path over the disc 18. That radially inner boundary is effectively a continuation of the radially outer surface defined by a generally conical nose cone 33 attached to the front of the fan disc 18. A further benefit of such axial inclination is that in the unlikely event of one of the fan blades 17 being damaged or broken off as a result of being impacted by a foreign object, the downstream loading of the fan blades 17 resulting from the axial inclination of their roots 24 counteracts the upstream loading resulting from the impact. This in turn reduces the upstream loading of the thrust ring 27 by the tang 25 in the case of the embodiment of FIG. 2. There are similar benefits to be enjoyed however in the embodiment of FIGS. 4–7 by virtue of the reduced axial loading upon the key 30.

Since the spacer members 21 serve the dual role of defining the fan root slots 23 and the radially inner boundary of the air flow path over the disc 18, significant savings in weight can be achieved. Thus there is no requirement for separate members between adjacent fan blades 17 to define the radially inner boundary of the air flow passage through the fan assembly 12. Such members would conventionally be defined either by circumferentially extending platform pieces which are integral with the fan blades 17 or by separate spacer members which are positioned one between circumferentially adjacent fan blades 17 pair and which are attached to the fan disc 18.

Additionally, since the roots 24 of the fan blades 17 are positioned close to the radially outer surface of the disc 18, they are shorter, and therefore lighter than would normally have been the case had the root slots 23 been closer to the axis of the disc 18 where they are conventionally located. It will be seen therefore that the present invention facilitates a bladed rotor having a higher hub to tip ratio than is normally the case and which is therefore lighter than conventional bladed rotors.

Although the present invention has been described with reference to a rotor disc which is suitable for use with fan blades, it will be appreciated that it could also be used in conjunction with compressor and turbine aerofoil blades.

We claim:

1. A rotor disc for carrying an annular array of radially extending aerofoil blades each having a root and a tip in a gas turbine engine, said disc being provided with a plurality of generally axially extending circumferentially spaced apart slots in its periphery to receive said roots of said aerofoil blades, said disc comprising at least two sub-discs which are maintained in axially spaced apart relationship by a plurality of axially extending circumferentially spaced apart spacer members positioned in the peripheral regions of said sub-discs, said spacer members at least partially defining the radially inner boundary of the gas flow path over said disc between adjacent ones of said slots, each of said slots containing a said root of an aerofoil blade, each said root having a key associated therewith which interacts with at least one of said sub-discs to provide axial locking of an associated aerofoil blade root, each said aerofoil blade root having a mid-region and said key being located in said mid-region of an associated aerofoil blade root so as to protrude beyond the periphery of said root into the space between two of said sub-discs, said sub-discs having radial surfaces and said key interacting with said radial surfaces to facility said axial locking of said aerofoil blade root.

2. A rotor disc as claimed in claim 1 wherein each of said spacer members is integral with its associated sub-disc.

3. A rotor disc as claimed in claim 1 wherein said spacer members are shaped so as to cooperate with an adjacent spacer member to define said aerofoil blade root receiving slot.

4. A rotor disc as claimed in claim 1 wherein each of said sub-discs is provided with a plurality of said spacer members, each of said spacer members on one of said sub-discs confronting and being attached to a corresponding spacer member on its adjacent sub-disc at a position axially intermediate said adjacent sub-discs.

5. A rotor disc as claimed in claim 4 wherein said corresponding spacer members are attached to each other by welding.

6. A rotor disc as claimed in claim 1 wherein said aerofoil blade root receiving slots are axially inclined.

7. A rotor disc as claimed in claim 1 wherein said key is in the form of a tang which is attached to one end of its associated aerofoil blade root to engage an end face of said sub-discs.

8. A rotor disc as claimed in claim 1 wherein each of said aerofoil blade roots is of dovetail cross-sectional configuration and each of said slots in said disc is correspondingly configured so as to receive and radially retain one of said aerofoil blade roots, each of said slots having a greater radial depth than the root which it receives to permit the radial translation of said root between a first position in which its associated key does not interact with said sub-disc radial surfaces and a second position in which said associated key does interact with said sub-disc radial surfaces, retention means being provided to selectively maintain said root in said second position.

9. A rotor disc as claimed in claim 8 wherein said retention means comprises a chocking member selectively positionable between said aerofoil blade root and radially inner part of said slot.

10. A rotor disc as claimed in claim 1 wherein in combination with a ducted fan gas turbine engine having a fan assembly and said disc is part of said fan assembly of said ducted fan gas turbine engine.

* * * * *